US005632258A

United States Patent [19]

Tsuzuki et al.

[11] Patent Number: 5,632,258

[45] Date of Patent: May 27, 1997

[54] EXHAUST GAS RECIRCULATION CONTROL APPARATUS FOR AN INTERNAL COMBUSTION ENGINE

[75] Inventors: Kunihiro Tsuzuki, Obu; Hiroo Tsujimoto, Kariya; Yukihiko Takeuchi, Handa; Shiro Maeda, Kariya, all of Japan

[73] Assignee: Nippondenso Co., Ltd., Kariya, Japan

[21] Appl. No.: 605,669

[22] Filed: Feb. 22, 1996

[30] Foreign Application Priority Data

| | | | |
|---|---|---|---|
| Feb. 28, 1995 | [JP] | Japan | 7-039834 |
| May 18, 1995 | [JP] | Japan | 7-120069 |
| Nov. 10, 1995 | [JP] | Japan | 7-293157 |

[51] Int. Cl.[6] ..... F02M 25/07

[52] U.S. Cl. ..... 123/571

[58] Field of Search ..... 123/320, 321, 123/568, 569, 571, 90.14

[56] References Cited

U.S. PATENT DOCUMENTS

| | | | |
|---|---|---|---|
| 3,974,807 | 8/1976 | Nohira et al. | 123/568 |
| 4,088,101 | 5/1978 | Wakita | 123/568 |
| 4,170,971 | 10/1979 | Yamanaka et al. | 123/568 |
| 4,314,532 | 2/1982 | Payne | 123/571 |
| 4,445,488 | 5/1984 | Tanaka et al. | 123/569 |

FOREIGN PATENT DOCUMENTS

| | | |
|---|---|---|
| 4-255558 | 9/1992 | Japan . |
| 5-47402 | 6/1993 | Japan . |

*Primary Examiner*—Willis R. Wolfe

*Attorney, Agent, or Firm*—Cushman, Darby & Cushman IP Group of Pillsbury Madison & Sutro LLP

[57] ABSTRACT

According to the present invention, the exhaust gas recirculation control apparatus includes a first switching valve for controlling communication between the positive pressure supplying source and the control valve. The first switching valve opens only when the control means increases and maintains the predetermined pressure supplied to the EGR valve, and under other conditions, the first switching valve closes, so that the positive pressure of the positive pressure supplying source can be utilized only when needed and the positive pressure accumulated inside the positive pressure supplying source can be prevented from leaking from the control valve. When an air compressor, which is mounted for a braking in a vehicle, is commonly used for the EGR valve as the positive pressure supplying source, air pressure of the brake system in the air compressor can be effectively used, a small-sized EGR apparatus being thereby manufactured.

15 Claims, 11 Drawing Sheets

FULL CLOSED CONDITION

FULL OPEN CONDITION

EXHAUST GAS RECIRCULATION CONTROL APPARATUS FOR AN INTERNAL COMBUSTION ENGINE

CROSS REFERENCE TO RELATED APPLICATIONS

This application is based upon and claims priority from Japanese Patent Applications No. Hei. 7-39834, filed on Feb. 28, 1995, No. Hei. 7-120069, filed on May 18, 1995, and No. Hei. 7-293157, filed on Nov. 10, 1995 with the contents of each document being incorporated herein.

BACKGROUND OF THE INVENTION

1. Field of the Invention

The present invention relates to an apparatus for controlling exhaust gas recirculation for use in an internal combustion engine.

2. Description of Related Art

Conventionally, a so-called exhaust gas recirculation control apparatus including an exhaust gas recirculation valve (hereinafter called as EGR valve) is mounted on an internal combustion engine to recirculate a portion of exhaust gas to an intake air passage to decrease combustion temperature inside an engine cylinder, so that NOx in the exhaust gas can be reduced.

Japanese Patent Laid-Open Publication No. Sho 58-67954 discloses an apparatus for controlling exhaust gas recirculation in a diesel engine, which includes a sensor for detecting operating conditions of the diesel engine, a control circuit for controlling an electric actuator based on a signal from the sensor, a proportional control valve having a spool valve, a sleeve, a diaphragm and a spring, for adjusting pressure to a preset value when the electric actuator applies an electromagnetic force to the spool valve, a negative or positive pressure pump for supplying pressure to the proportional control valve, a diaphragm chamber for receiving pressure from the proportional control valve, and an EGR valve actuated by pressure in the diaphragm chamber.

Generally, for a vehicle having a small-sized diesel engine, the EGR apparatus recirculates a portion of exhaust gas to the intake air passage to reduce combustion temperature inside the engine cylinder, thereby decreasing NOx in the exhaust gas.

Recently, an EGR apparatus has increasingly been demanded for a vehicle having not only a small-sized diesel engine but also a medium or large-sized engine to reduce the amount of NOx.

Under these circumstances, the inventors have conceived that an EGR apparatus is mounted on a vehicle with a large-sized diesel engine and is actuated by using a positive pressure supplying source to generate positive pressure, which is higher than the atmospheric pressure, such as positive pressure of the air compressor to actuate the brake system or the like.

However, in the conventional proportional control valve which adjusts the introduced atmospheric pressure and the positive pressure supplied by the pump, there is a clearance between the spool valve body and the valve casing, where the spool valve slides. The positive pressure introduced into the proportional control valve by the pump may be released from the above-mentioned clearance when the EGR valve is not being actuated. Since the positive pressure in the proportional control valve is reduced, the reduced positive pressure has to be compensated by operating the pump to actuate the spool valve body of the EGR valve by a predetermined distance when the EGR valve is actuated again, thereby increasing the load of the pump. For example, when the same air pump for the EGR apparatus, such as air compressor, is used to produce the positive pressure to operate the brake system, loss of the positive pressure generated by the pump has to be suppressed to prevent the adverse influence on the brake system.

SUMMARY OF THE INVENTION

In light of the above-described problem, an object of the present invention is to provide an EGR apparatus capable of utilizing positive pressure higher than the atmospheric pressure produced by a positive pressure supplying source and preventing the leakage of the positive pressure accumulated in the positive pressure supplying source.

According to the present invention, the pressure introduced to the pressure chamber of the EGR valve is controlled by positive pressure which is higher than the atmospheric pressure, so that the control range of pressure in the pressure chamber of the EGR valve can be enlarged and the opening degree of the valve can be precisely adjusted with rapid response. A first switching valve controls communication between the positive pressure supplying source and the control valve. The first switching valve opens only when the control means increases and maintains the predetermined pressure supplied to the EGR valve, and under other conditions, the switching valve closes, so that the positive pressure of the positive pressure supplying source can be utilized only when needed and the positive pressure accumulated inside the positive pressure supplying source can be prevented from leaking from the control valve. Furthermore, in case, for example, an air compressor, which is mounted for other purposes (such as a braking system) in a vehicle, is commonly used for the EGR valve as the positive pressure supplying source, air pressure of the brake system in the air compressor can be effectively used, a small-sized EGR apparatus being thereby manufactured.

The first switching valve is opened by the control means only when exhaust gas is recirculated into the internal combustion engine the EGR valve, i.e., the first switching valve is closed when exhaust gas is not recirculated. In this way, positive pressure accumulated inside the positive pressure supplying source can be prevented from leaking from the control valve when the EGR valve is not being actuated.

When pressure in the pressure chamber of the EGR valve increases, a first switching valve is opened to provide operational pressure to the EGR valve, and when the pressure in the pressure chamber decreases or is maintained, the first switching valve is closed to control the control valve. Therefore, only when needed, positive pressure can be utilized from, for example, an air compressor as a positive pressure supplying source, so that the load of the positive pressure supplying source can be reduced, moreover, not only the size of a positive pressure supplying source can be made smaller, but also fuel consumption of an actuating source of the positive pressure supplying source such as an internal combustion engine can be reduced.

When a constant pressure valve is disposed to close communication between the control valve and the positive pressure supplying source when the differential pressure is less than a predetermined value, pressure of the positive pressure supplying source can be maintained at a predetermined value or more so as to prevent pressure leakage.

It is preferable for the EGR valve to include a diaphragm made of a flexible material rollingly moving without causing friction when the EGR valve is actuated. In this structure, a first contacting portion of the diaphragm, the inner wall of the pressure chamber in the case, a second contacting portion of the diaphragm, and the outer cylindrical wall of a moving member do not rub against each other in principle. Consequently, the durability of the diaphragm improves. Especially when the present invention is applied to an internal combustion engine for such a vehicle as a truck running more than 1 million km, the effect of improved durability of the diaphragm can be remarkably advantageous.

According to the structure of the aforementioned diaphragm in the EGR valve, it is possible to reduce hysteresis caused by the diaphragm and can improve linearity, thus, linear control of the opening degree of the valve can be accurately performed. Furthermore, the diaphragm prevents pressure in the pressure chamber of the EGR valve from leaking so as to eliminate an adverse effect which may be given to the brake system by the air compressor as a positive pressure supplying source.

A spool valve can be employed as the control valve for controlling pressure of the EGR valve, so that the position of the spool can be accurately adjusted in accordance with the electric volume supplied to the spool valve. A desired opening degree of the valve on the basis of the spool position can be easily obtained, and therefore, it is possible to provide an accurate pressure signal promptly to the EGR valve. Therefore, responsibility will be much improved. By combining the spool with the EGR valve having the above diaphragm, multiple effects are given to EGR control. That is, a long durability is assured and the opening degree of the EGR valve can be precisely and rapidly controlled by the command of the control unit.

BRIEF DESCRIPTION OF THE DRAWINGS

Additional objects and advantages of the present invention will be more readily apparent from the following detailed description of preferred embodiments thereof when taken together with the accompanying drawings in which:

FIG. 4A is a view where the proportional electromagnetic control valve is fully closed while FIG. 4B is a view where the proportional electromagnetic control valve is fully opened;

DETAILED DESCRIPTION OF THE PRESENTLY PREFERRED EXEMPLARY EMBODIMENTS

The preferred embodiments of the present invention are hereinafter described with reference to the accompanying drawings.

A first embodiment of an EGR apparatus for an internal combustion engine according to the present invention is described hereinafter with reference to FIG. 1.

Figure 1:
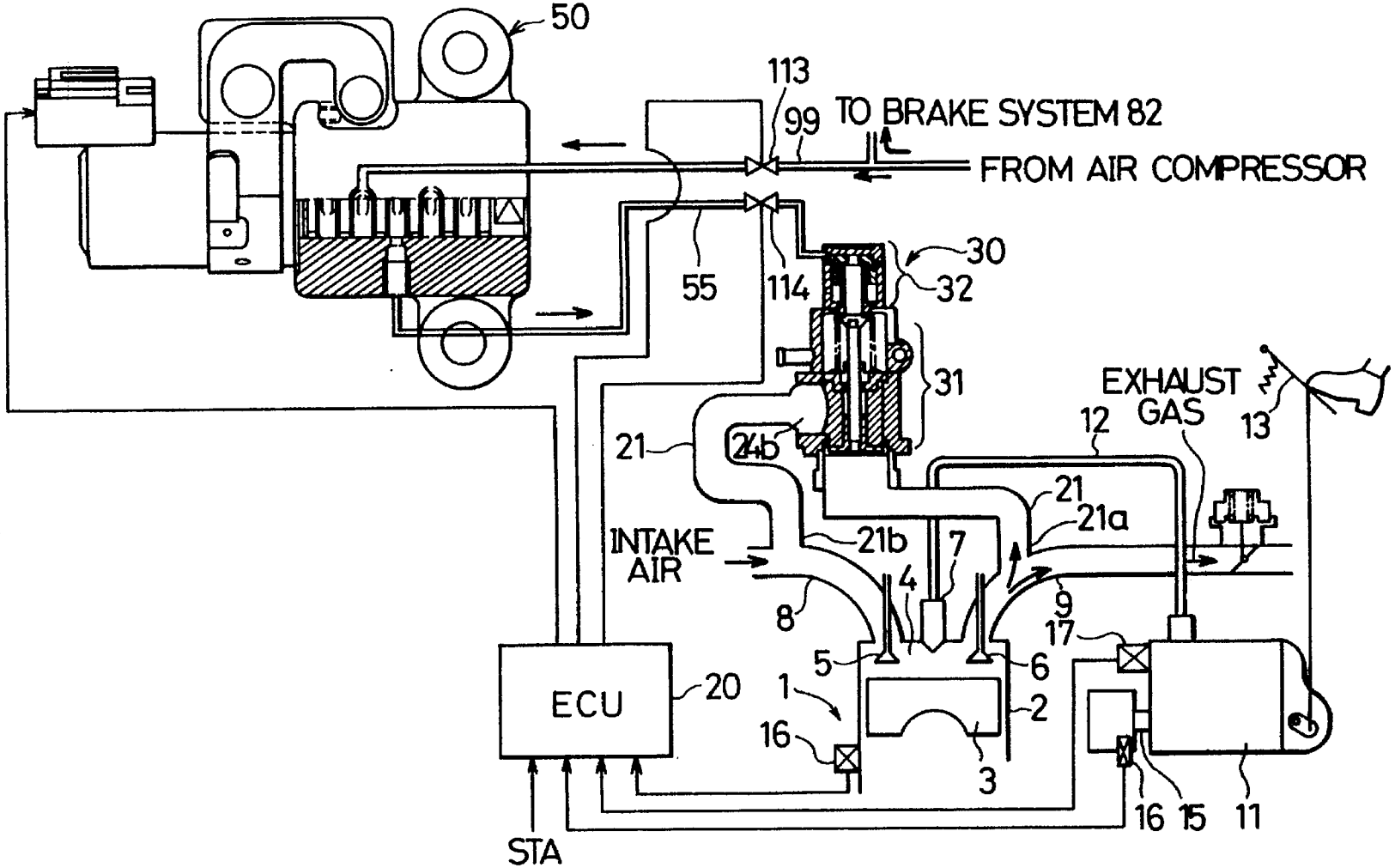
FIG. 1 is a general construction view of a first embodiment according to the present invention.

In FIG. 1, an internal combustion engine system includes an internal combustion engine body 1, a cylinder 2, a piston 3, a combustion chamber 4, an intake valve 5, an exhaust valve 6, a fuel injection nozzle 7, an intake passage 8, and an exhaust passage 9.

In a fuel injection system, fuel sucked by an injection pump 11 from a fuel tank (not shown) is pressurized, and the high pressure fuel is injected from a fuel injection nozzle 7 to a cylinder through a fuel pipe 12, respectively. Injection timing of the fuel is determined by fuel injection pump 11. A predetermined amount of fuel is selectively distributed by fuel injection pump 11 at the predetermined timing and injected into the cylinder from fuel injection nozzle 7 at the predetermined timing. The amount of injected fuel is basically determined by a movement amount of the accelerator pedal by a driver and the rotational speed of the internal combustion engine. The injection timing of fuel injection pump 11 is determined by the position of rotation angle of a cam shaft 15. The amount of injected fuel is determined by the position of a rack (not shown) of the fuel injection pump 11. A rotation angle sensor 16 detects the angle of rotation. A rack position sensor 17 detects the position of the rack. A signal of rotation angle of the engine crank shaft detected by rotation angle sensor 16 and a signal of fuel injection amount (load sensor) determined by the rack position are respectively input into an electronic control unit (ECU) 20. A water temperature sensor 18 detects temperature of cooling water within the internal combustion engine body 1. A signal of detected water temperature is input into ECU 20. A start signal STA from a start switch (not shown) is also input into ECU 20.

Exhaust gas recirculation passage 21 for recirculating a portion of exhaust gas to intake passage 8 includes two ends 21*a* and 21*b*. One end 21*a* is connected to exhaust passage 9 and the other end 21*b* is connected to intake passage 8. Exhaust gas recirculation passage 21 is equipped with an exhaust gas recirculation valve (EGR valve) 30 to adjust the flowing rate (flowing amount) of recirculated exhaust gas. The opening degree of EGR valve 30 is controlled by a proportional control valve 50 based a command of ECU 20.

Figure 2:
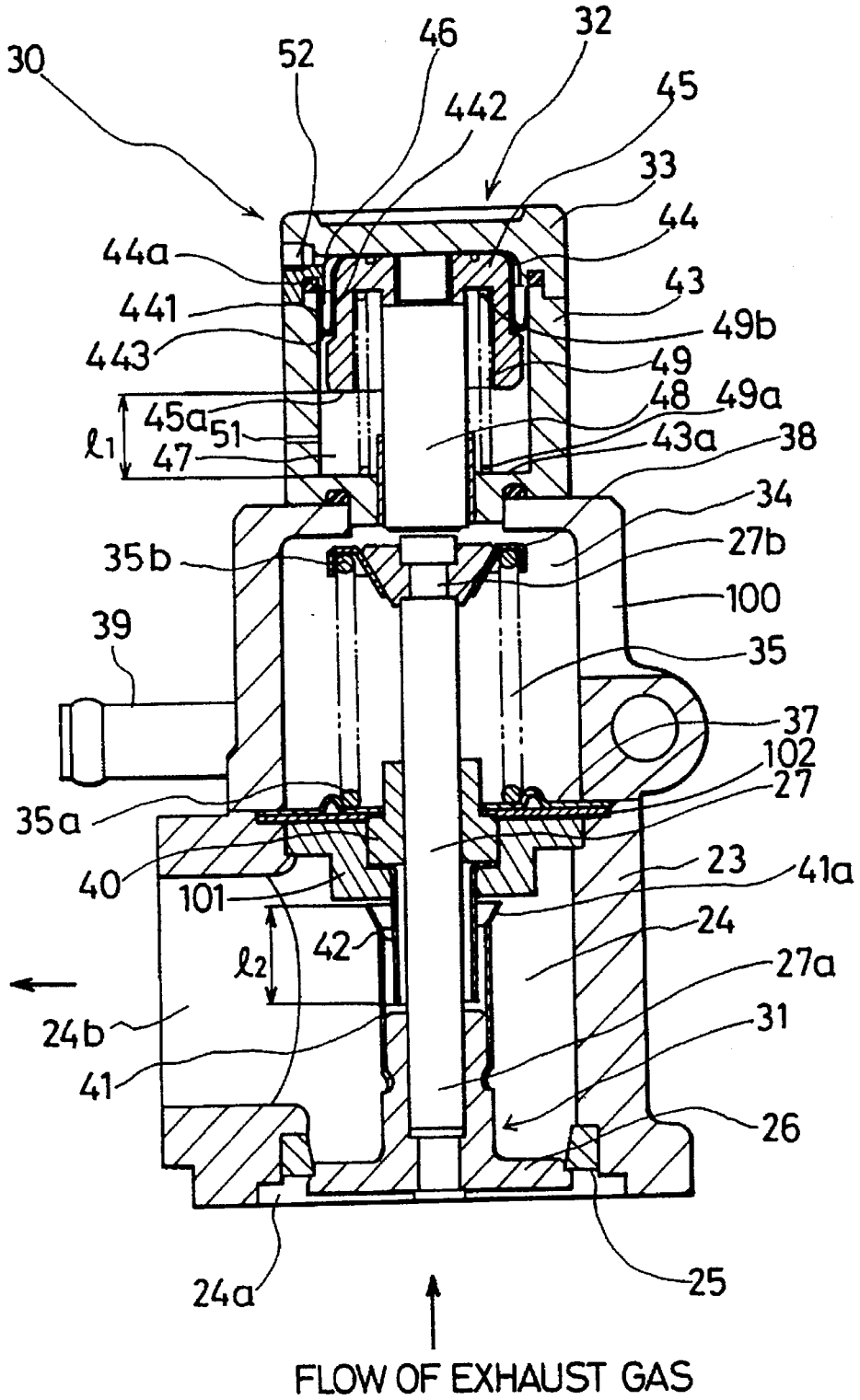
FIG. 2 is a sectional view of the EGR valve of the first embodiment.

A detailed structure of EGR valve 30 is as shown in FIG. 2. EGR valve 30 includes a valve portion 31 and an actuating portion 32 to actuate valve portion 31.

A fluid passage 24 is formed in a housing 23 in valve portion 31. A ring-shaped valve seat 25 is provided on a part of the inner wall forming fluid passage 24. A valve body 26 seats on valve seat 25. One end 27*a* of a valve shaft 27 is fixed to valve body 26.

In FIG. 2, the valve is disposed in a closed state. When valve shaft 27 moves downwardly, valve body 26 separates from valve seat 25 so that an exhaust gas inlet 24*a* at an upstream side of valve body 26 communicates with an exhaust gas outlet 24*b* at an downstream side of valve body 26. The opening area of the valve is decided by the moving amount of valve shaft 27. A first compressed coil spring 35 contained in a spring container 34 of housing 23 applies pressure to valve shaft 27 so as to close the valve. That is, one end 35*b* of first compressed coil spring 35 contacts with a fixed spring seat 38 fixed to housing 23 while the other end 35*a* contacts with a movable spring seat 37 fixed to the other end 27*b* of valve shaft 27. Cooling water passing in a pipe 39 cools spring container 34. Spring container 34 communicates with the atmosphere through an atmosphere hole 100.

A bearing 40 for slidably guiding valve shaft 27 is inserted into a bearing guide 101 and is fixed between bearing guide 101 and fixed spring seat 37 via an insulator 102. A first pipe 42 is disposed at one end of bearing 40 so as to form a sufficient clearance (more than 1 mm) around valve shaft 27. A second pipe 41 is disposed outside first pipe 42 so as to a sufficient clearance (more than 1 mm) and is fixed to the base of valve body 26. The diameter of second pipe 41 is enlarged at the top in the shape of a trumpet 41*a*. Therefore, first and second pipes 42 and 41 form a double-layered pipe structure. An overlapping length $l_2$ is longer than a valve stroke $l_1$ (described below), i.e., $l_2>l_1$. That is, the overlapping length is secured, even when the valve is fully opened. When the exhaust gas in fluid passage 24 moves into the clearance between bearing 40 and valve shaft 27, the gas in fluid passage 24 first comes inside from a trumpet-shaped portion 41*a* of second pipe 41, makes a U-turn and then goes inside a first pipe 42. By this labyrinth structure, it is hard for the exhaust gas to go into the upper spring container 34 from the clearance between bearing 40 and valve shaft 27. In this structure, since it is difficult for deposit ingredients contained in the exhaust gas to go into the upper part of spring container 34, long life of valve shaft 27 can be secured. Furthermore, an enlarged top, i.e., trumpet-shaped portion 41*a* guides the exhaust gas outwardly in an radial direction, so that the exhaust gas is prevented from flowing into the double-layered pipe structure and further into shaft 27.

Figure 3A:
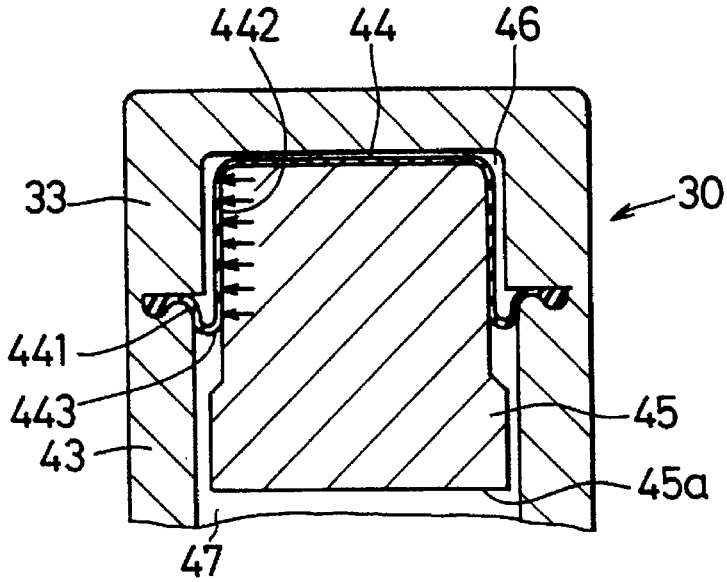
FIGS. 3A–3C are views to explain the operation of the diaphragm of the EGR valve.
Figure 3B:
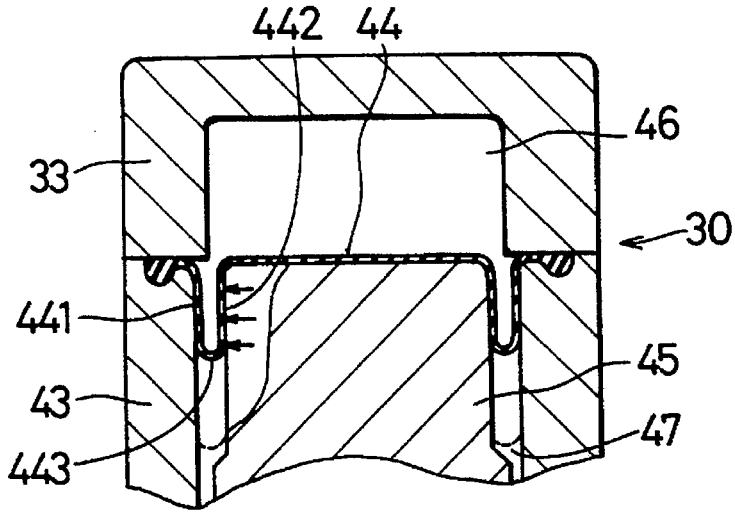
Figure 3C:
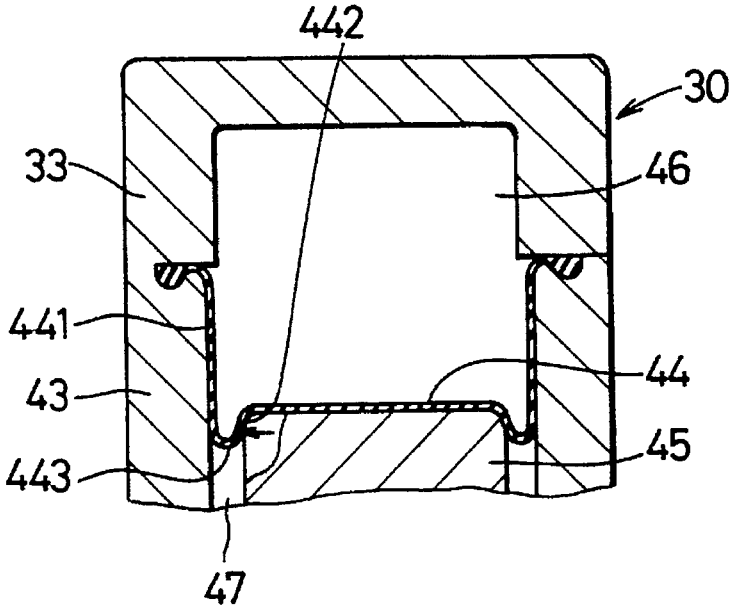

In actuating portion 32, a flange 44*a* in the shape of a ring on the outer periphery of a diaphragm 44 fits into a portion between an upper case 33 and a lower case 43 as shown in FIGS. 3A–3C. Diaphragm 44 is made of flexible material such as (BELLOFRAM)—trade name. Diaphragm 44 has a first contacting portion 441 contacting with the inner wall of a pressure chamber 46 of lower case 43, a second contacting portion 442 contacting with the cylindrical outer periphery of a shaft holder 45 as a moving member, and a connecting portion 443 connecting first contacting portion 441 with second contacting portion 442. When predetermined pressure is introduced into pressure chamber 46, connecting portion 443 moves into an atmospheric pressure chamber 47. Connecting portion 443 and second contacting portion 442 smoothly slide and move toward the inner wall of pressure chamber 46 from the cylindrical outer periphery of shaft holder 45.

Lower case 43 is fixed to an upper portion of the housing 23. Upper and lower cases 33 and 43 form a chamber which is divided by diaphragm 44 into an upper pressure chamber 46 and a lower atmospheric pressure chamber 47. A shaft holder 45, a cylinder shaft 48 and a second compressed coil spring 49 are contained in atmospheric pressure chamber 47. One end 49*a* of second compressed coil spring 49 contacts with lower case 43 while the other end 49*b* contacts with shaft holder 45. Cylinder shaft 48 and shaft holder 45 are engaged with each other. Atmospheric pressure chamber 47 communicates with the outside through an atmospheric port 51 connecting the inner and outer sides of lower housing 43. Pressure chamber 46 communicates with a control port 52 connecting the inner and outer sides of upper case 33. Control port 52 shown in FIG. 1 communicates with an OUT port 75 in FIGS. 4A and 4B of a proportional control valve 50 through a pressure control passage 55.

Proportional control valve 50 is described hereinafter with reference to FIGS. 4A and 4B.

Positive pressure is introduced from an air compressor 81 through an IN port 74. Output pressure of proportional control valve 50 is taken out of an OUT port 75 and is supplied to pressure chamber 46 of EGR valve 30. An EX port 76 communicates with the atmosphere. An F/B port 77 communicates with the aforementioned OUT port 75.

Figure 4A:
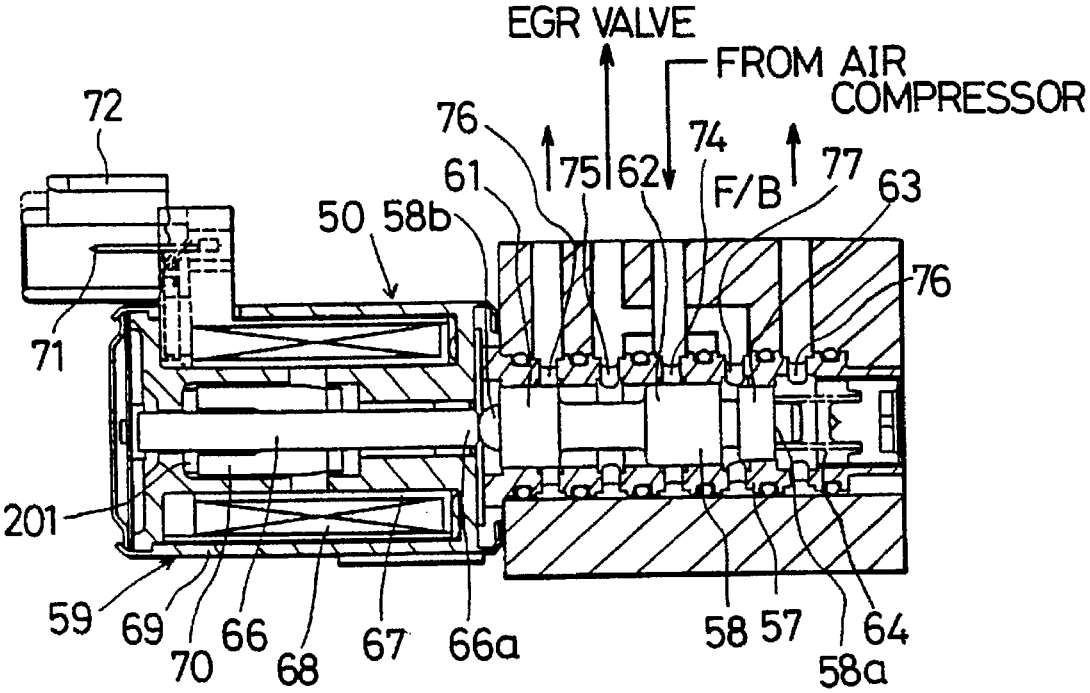
FIGS. 4A and 4B show a longitudinal cross sectional view of a proportional electromagnetic control valve.
Figure 4B:
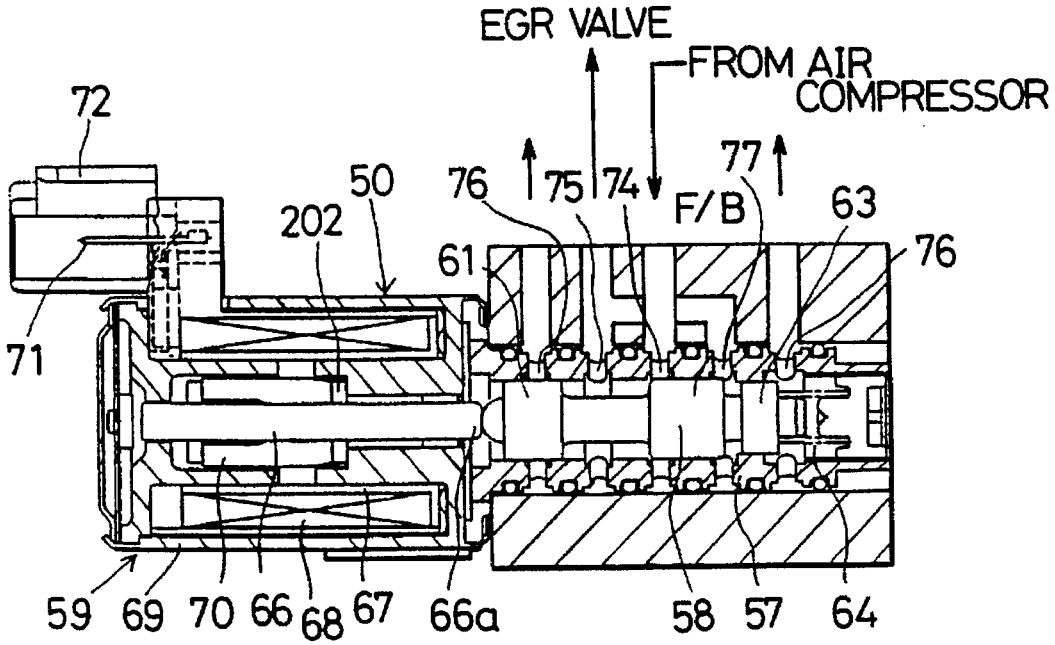
Figure 6:
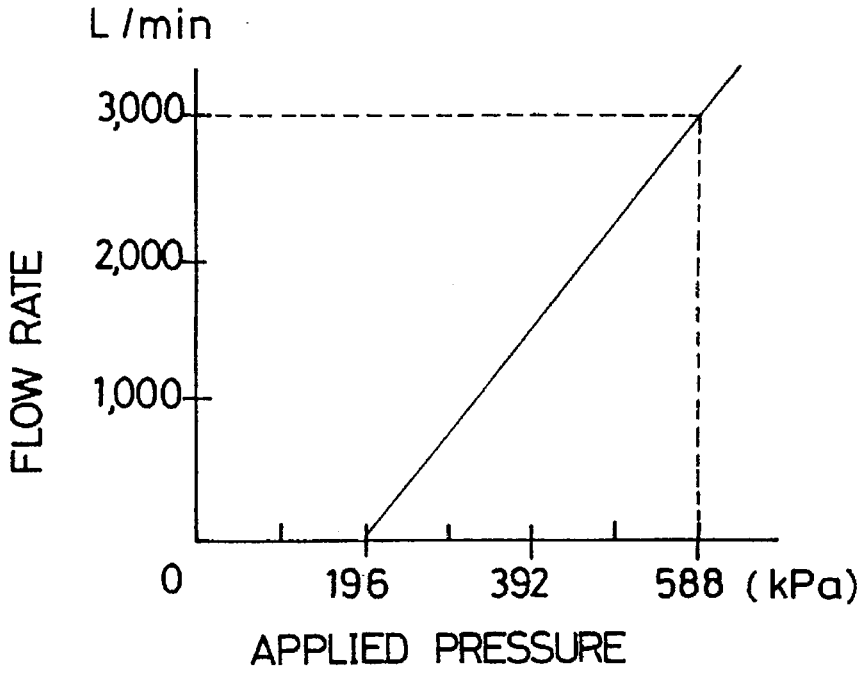
FIG. 6 is a graph showing the relationship between the air application voltage and the flow rate of exhaust gas in the EGR valve of the first embodiment.
Figure 7:
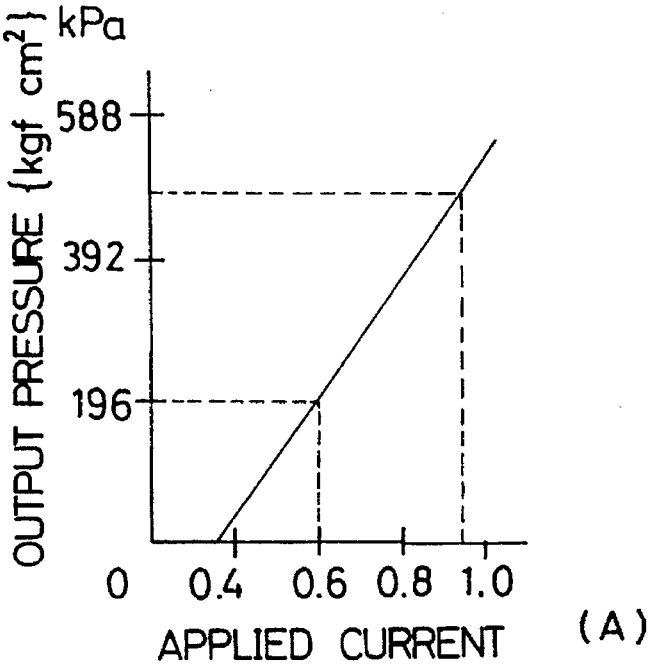
FIG. 7 is a graph showing the relationship between the applied current and output pressure in the proportional electromagnetic control valve of the first embodiment.

FIG. 4A shows a view where the valve is fully closed while FIG. 4B shows a view where the valve is fully opened. That is, in FIG. 4A, a spool 58 is disposed at the most leftward position relative to a valve body 57, on the other hand, in FIG. 4B, spool 58 is disposed at the most rightward position relative to valve body 57. A spool valve is incorporated into proportional control valve 50. A cylindrical hole extending in a longitudinal direction is formed inside valve body 57. Spool 58 includes land portions 61, 62, and 63, each of which has a larger diameter and is capable of sliding reciprocally in the axial direction along the inner wall of the cylindrical hole. A compressed coil spring 64 applies pressure to one end 58*a* of spool 58 in the left direction in FIG. 4A. The left end 58*b* of spool 58 in FIG. 4A contacts with one end 66*a* of a movable shaft 66. A housing 69 is fixed to valve body 57 by crimping. Bobbin 67 where a coil 68 is wound is fixed inside housing 69 in actuating portion 59 of valve body 57. Housing 69 made of a magnetic material forms a part of a magnetic circuit. A movable shaft 66 moving in the horizontal direction is radially disposed inside coils 68. A movable body 70 is fixed to the outer periphery of movable shaft 66. The left and right ends 201 and 202 fixed to movable body 70 are made of a non-magnetic material (such as brass) and move integrally, preventing movable body 70 from being attracted and also functioning as left and right stoppers, respectively. One end 201 is provided at the most leftward position and contacts with housing 69 in FIG. 4A while the other end 202 is provided at the most rightward position and contacts with housing 69 in FIG. 4B. A terminal 71 for supplying electric current to coil 68 is provided to a connector housing 72. When electric current is supplied to terminal 71, coil 68 is electrified to be excited. Then, magnetic line is formed, and a magnetic circuit is formed. When the magnetic circuit is formed, movable body 70 moves linearly in the right direction (up to the most rightward position) in FIGS. 4A and 4B according to the amount of electric current. Movable shaft 66 is positioned according to the balance of power. Since the position of movable shaft 66 is determined depending on the electric current value of the electric supply, the position in the horizontal direction of spool 58 contacting one end 66*a* of movable shaft 66 is inevitably determined. That is, output pressure to EGR valve is naturally determined by air pressure flowing from IN port 74 to OUT port 75 by air compressor 81 passing between the outer peripheral wall of land 62 and the inner wall of the hole of valve body 57. The opening degree of the spool valve is determined in proportion to the amount of the outer peripheral wall of land 62 which overlaps the inner wall forming the hole of valve body 57. FIG. 4A shows a fully-closed state while FIG. 4B shows a full-open state. The opening degree of the spool valve is proportionally controlled between the fully-closed state and full-open state. FIG. 7 shows a relationship between electric current supplied to terminal 71 and output pressure from OUT port 75 of spool valve 50 as a proportional control valve. In FIG. 7, it is characterized that, the more the impressed electric current increases, the more the output pressure increases proportionally. The output pressure is introduced into pressure chamber 46 of EGR valve 30 through control passage 55 shown in FIG. 1. FIG. 6 shows the relationship between the applied pressure of pressure chamber 46 and the amount of the exhaust gas passing in fluid passage 24 in FIG. 2. FIG. 6 also shows the characteristics of flowing amount of EGR valve 30.

In FIG. 1, air pressure from air compressor 81 is introduced into IN port 74 of spool valve 50. The output pressure from air compressor 81 is introduced to a brake system 82 in addition to spool valve 50. This pressure is positive, for example, 8–9 kgf/cm$^2$ at its maximum. Spool valve 50 precisely controls the output pressure of OUT port 75 according to the overlapping amount of land portion 62 and the inner wall of the hole of valve body 57. As a result, pressure chamber 46 of EGR valve 30 is also precisely controlled, so that an opening degree of valve body 26 at the end of valve shaft 27 is precisely and promptly adjusted. Such precise and prompt control can be obtained by the combination of spool valve 50 and EGR valve 30. Moreover, since pressure is controlled by utilizing positive pressure, an absolute value of control range of pressure can be maximized so that control can be linearly and minutely preformed. Therefore, an opening degree of EGR valve 30 can be also precisely and responsively adjusted according to the electric current value by a command of an electric signal from control unit 20. The exhaust gas recirculation amount of a diesel engine can be appropriately, minutely and precisely controlled on the basis of operating situations and conditions of the diesel engine. Thus, it is possible to effectively improve exhaust gas emission by reducing NOx effectively.

Positive pressure from air compressor 81 as a supplying source of positive pressure is supplied to proportional control valve 50 through pressure transmitting passage 99 as a first supplying passage. A first electromagnetic valve 113 as a first switching valve is disposed in pressure transmitting passage 99. Predetermined pressure from proportional control valve 50 is supplied to EGR valve 30 through a control passage 55 as a second supplying passage. A second electromagnetic valve 114 as a second switching valve is disposed in control passage 55. First electromagnetic valve 113 and second electromagnetic valve 114 are actuated (opened or closed) by receiving a command signal from ECU 20, respectively.

First electromagnetic valve 113 prevents the positive pressure introduced to proportional control valve 50 from leaking to the atmosphere from the clearance between valve body 57 and spool 58. Second electromagnetic valve 114 prevents the pressure inside pressure chamber 46 of EGR valve 30 from leaking to the atmosphere. Because the pressure from air compressor 81 as a supplying source of positive pressure can be maintained by first electromagnetic valve 113, it functions as a safety valve to perform the operation of brake system 82 accurately.

Because second electromagnetic valve 114 prevents the pressure in pressure chamber 46 of EGR valve 30 from leaking outside, it is possible to effectively and accurately control a switching between the open state and closed state of EGR valve 30.

An operation of EGR valve 30 is hereinafter described. When pressure value in pressure chamber 46 increases, the pressure is imposed on diaphragm 44. Shaft holder 45 supporting diaphragm 44, cylinder shaft 48, valve shaft 27 and valve body 26 in EGR valve 30 move downwardly in FIG. 2 while resisting first and second compressed coil springs 35 and 49. EGR valve 30 is actuated based on the increase of the pressure value in pressure chamber 46. For example, FIGS. 3A, 3B, and 3C show that EGR valve 30 is fully-closed, half-opened, and fully-opened, respectively. At the time of the full-open state, the lower end 45*a* of shaft holder 45 contacts with the lower end 43*a* of lower case 43, thus functioning as a stopper. A stroke of shaft holder 45 is in the range of $l_1$ shown in FIG. 2. In FIG. 3C, the pressure in pressure chamber 46 is the maximum pressure value.

As can be understood by comparing FIGS. 3A, 3B, and 3C, diaphragm 44 basically moves without sliding or rubbing on the inner walls of upper case 33 and lower case 43. Since diaphragm 44 principally moves without sliding on the inner walls in principle, diaphragm 44 is superior in durability. In case this exhaust gas recirculation system including diaphragm 44 is mounted on such a vehicle with a diesel engine which run more than 1 million km like a truck, EGR valve 30 can be effectively used for a long time. Diaphragm 44 can steadily maintain air tightness in pressure chamber 46, so that control pressure does not leak, thus preventing an adverse effect on the exhaust gas recirculation system of this embodiment due to the leakage of the control pressure and the brake system due to the leakage of air pressure. For instance, function of the brake can be prevented from being deteriorated.

Figure 8:
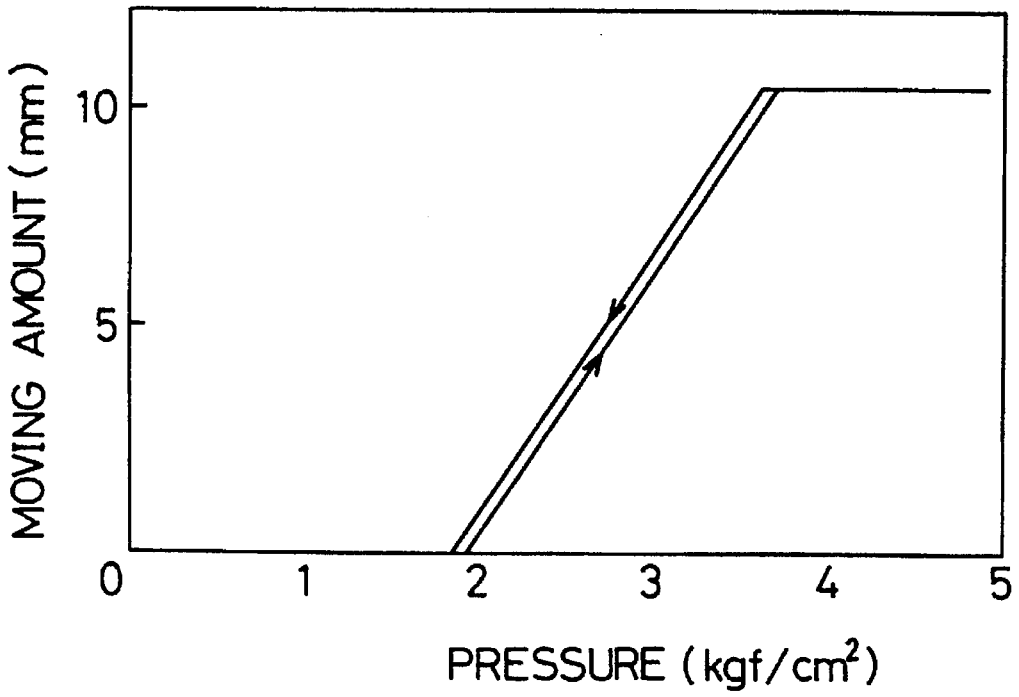
FIG. 8 is a graph showing the relationship between the pressure and the moving amount in the EGR valve of the first embodiment.
Figure 9:
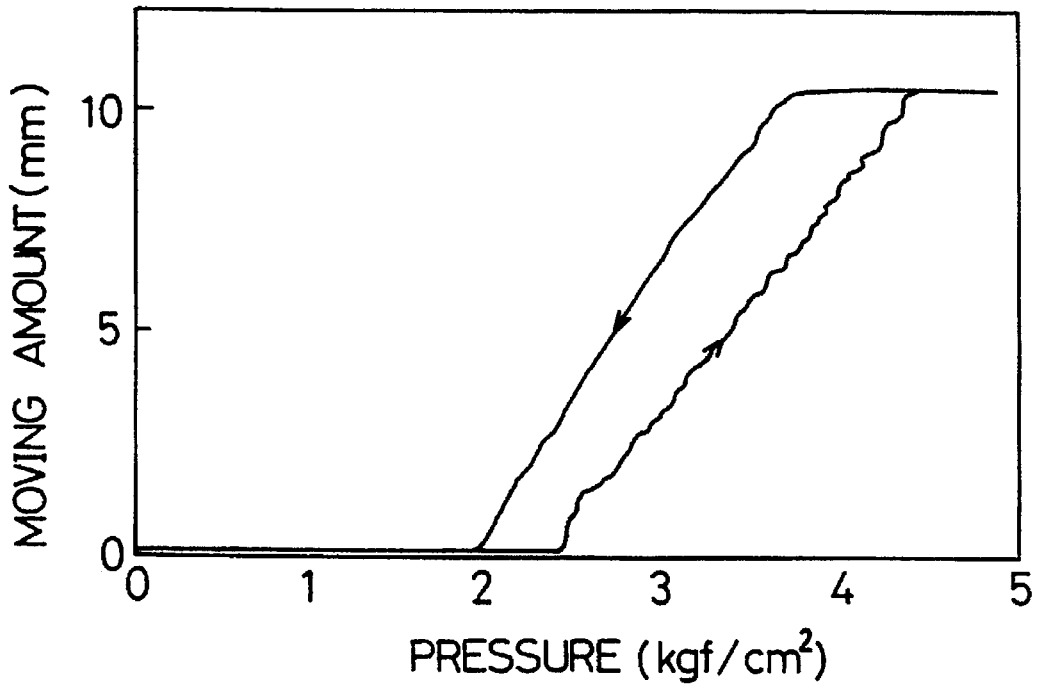
FIG. 9 PRIOR ART
FIG. 9 is a graph showing the relationship between the pressure and the moving amount in a conventional air cylinder type EGR valve for comparison.

Characteristics of a non-sliding type EGR valve including a diaphragm according to this embodiment and a conventional skidding-type EGR valve including an air cylinder are hereinafter compared individually. FIG. 8 shows characteristics of EGR valve 30 of this embodiment while FIG. 9 shows characteristics of a conventional EGR valve with an air cylinder.

In the conventional air cylinder-type EGR valve, a piston slides within the cylinder and is connected to a valve body. According to this piston-sliding type EGR valve as illustrated in FIG. 9, the relationship between the pressure in the pressure chamber of the air cylinder and the moving amount of the valve body clearly shows a step-like movement with large hysteresis. That is, there is an outstanding difference in the relationship between the pressure value and the moving amount comparing the time of the valve opening operation with that of the valve closing operation. This may be mostly caused by frictional sliding movement of the piston. In such a conventional EGR valve, since the moving amount remarkably fluctuates when the pressure value changes, the opening degree of the valve cannot be precisely controlled.

However, according to EGR valve 30 of this embodiment as shown in FIG. 8, the relationship between the pressure value in pressure chamber 46 and the moving amount of valve body 26 shows a continuous linear line with small hysteresis, because diaphragm 44 moves so as to roll along the inner wall of the pressure chamber without sliding on the inner wall. By controlling a pressure value in pressure chamber 46, an opening degree of valve body 26 can be accurately controlled. In this embodiment, the opening degree of EGR valve 30 can be precisely according to the basis of the pressure value transmitted to pressure chamber 46 through control passage 55 from spool valve 50.

In the first embodiment, first electromagnetic valve 113 as the first switching valve is disposed at the pressure input side of spool valve 50 as a proportional electromagnetic control valve and second electromagnetic valve 114 as the second switching valve is disposed at the pressure output side as the second switching valve. These first and second electromagnetic valves 113 and 114 are controlled to be opened or closed on receiving the command of ECU 20. First electromagnetic valve 113 switches between communication and shutoff of original pressure supplied from air compressor 81 to spool valve 50. On the other hand, second electromagnetic valve 114 switches between communication and shutoff of operational pressure supplied from spool valve 50 to EGR valve 30.

Relation between switching (opening/closing) operation of EGR valve 30 and operations of first and second electromagnetic valves 113 and 114 is hereinafter described.

When EGR valve 30 is closed, both first and second electromagnetic valves 113 and 114 are also closed. However, when an EGR amount is increased from the closed state of EGR valve 30, first and second electromagnetic valves 113 and 114 are switched to be opened. Then, pressure from air compressor 81 as a positive pressure supplying source is supplied as operational pressure to actuating portion 32 of EGR valve 30 through control passage 55. When operational pressure of actuating portion 32 reaches a target pressure, first and second electromagnetic valves 113 and 114 are switched to be closed. By this valve operation, operational pressure of EGR valve 30 is maintained in actuating portion 32 without consuming original pressure from air compressor 81. Thus, desired opening degree of EGR valve 30 can be maintained.

When an EGR amount is decreased from the above desired opening degree of EGR valve 30, the opening degree of EGR valve 30 is decreased. In this case, first electromagnetic valve 113 remains closed, however, second electromagnetic valve 114 is switched to be opened to control spool valve 50. Accordingly, operational pressure of actuating portion 32 is released to the atmosphere from spool valve 50 through control passage 55 to reduce the operational pressure of actuating portion 32 and to decrease the opening degree of EGR valve 30. When the operational pressure of actuating portion 32 reaches a target pressure, second electromagnetic valve 114 is switched off.

Furthermore, in case an EGR amount is decreased from the desired opening degree of EGR valve 30, alternatively, both first and second electromagnetic valves 113 and 114 are switched to be opened, and after spool valve 50 reaching a predetermined pressure for the reduced EGR amount, both first and second electromagnetic valves 113 and 114 switched to be closed to maintain a desired opening degree of EGR valve 30.

To suspend EGR control, first electromagnetic valve 113 should be closed and second electromagnetic valve 114 should be opened so as to dwindle operational pressure of actuating portion 32 to zero and finally EGR valve 30 is closed.

According to the first embodiment, first electromagnetic valve 113 adjusts air flowing amount supplied from air compressor 81 to spool valve 50. Therefore, when the original pressure from air compressor 81 is not necessary, the consumption of the original pressure in spool valve 50 can be kept zero by closing first electromagnetic valve 113, thus, air pressure of air compressor 81 can be saved.

Moreover, in the first embodiment, operational pressure of air compressor 81 is consumed only when actuating portion 32 of EGR valve 30 needs to increase the operational pressure, so that load of air compressor 81 can be reduced, which enables to manufacture a smaller-sized air compressor 81 and improve fuel efficiency of the internal combustion engine for actuating air compressor 81.

In the first embodiment, operational pressure of air compressor 81 can be utilized only when operational pressure of EGR valve 30 is increased. In the other operations, pressure of actuating portion 32 of EGR valve 30 can be adjusted by keeping first electromagnetic valve 113 closed and switching operation of spool valve 50 and second electromagnetic valve 114. Therefore, consumption of air pressure of air compressor 81 can be reduced, which consequently reduces the load of air compressor 81 and enables to manufacture a smaller-sized air compressor 81.

According to the first embodiment, because a positive pressure supplying source of the brake system is commonly used as a positive pressure supplying source to supply control pressure of EGR valve 30, an additional positive pressure source is not required. Furthermore, without causing pressure decrease of the positive pressure supplying source in the brake system, EGR can be precisely controlled. Whether the proportional control valve controlling EGR valve 30 is actuated or not, pressure is prevented from leaking, an accurate control of EGR valve 30 can thereby be performed.

Since the proportional control valve in the first embodiment is equipped with spool valve 50, the amount of air supply from IN port 74 to OUT port 75, i.e., pressure value can be accurately controlled in accordance with the horizontal position of spool 58 in FIG. 4 on the basis of the overlapping amount of land portion 62 of spool 58 and the inner wall of the hole of valve body 57. Spool 58, a component of spool valve 50, adjusts electromagnetic attracting force according to the amount of electricity supplied to coil 68 of actuating portion 59 based on the command of ECU 20. Spool 58 moves to an appropriate position corresponding to the value of electromagnetic attraction force.

ECU 20 receives signals from a rack position sensor 17, a rotation angle sensor 16, a water temperature sensor 26, and a start switch, then processes those input signals and finally transmits the signals to a terminal 71 of proportional control valve 50 as electric current signals. A magnetic circuit is formed around coil 68 according to the amount of the electric current supplied to terminal 71. According to magnetic force of the magnetic circuit, a movable shaft 66 is attracted to a desired position in the right direction in FIG. 4 while resisting the force of compressed coil spring 64, the position of spool 58 being thereby determined by the magnetic attraction force for attracting movable shaft 66 which urges spool 58. Depending on the position of spool 58, pressure value supplied from OUT port 75 is supplied to pressure chamber 46 of EGR valve 30 through control passage 55. Valve opening position of valve shaft 27 is determined on the basis of the balance between the force represented by multiplying pressure in pressure chamber 46 of EGR valve 30 with an effective area for receiving pressure of diaphragm 44 and urging force of both first and second compressed coil springs 35 and 49. Exhaust recirculation amount guided to exhaust gas outlet **24*b* through fluid passage 24 from exhaust gas inlet 24*a*** is also determined according to the valve opening position.

Figure 5:
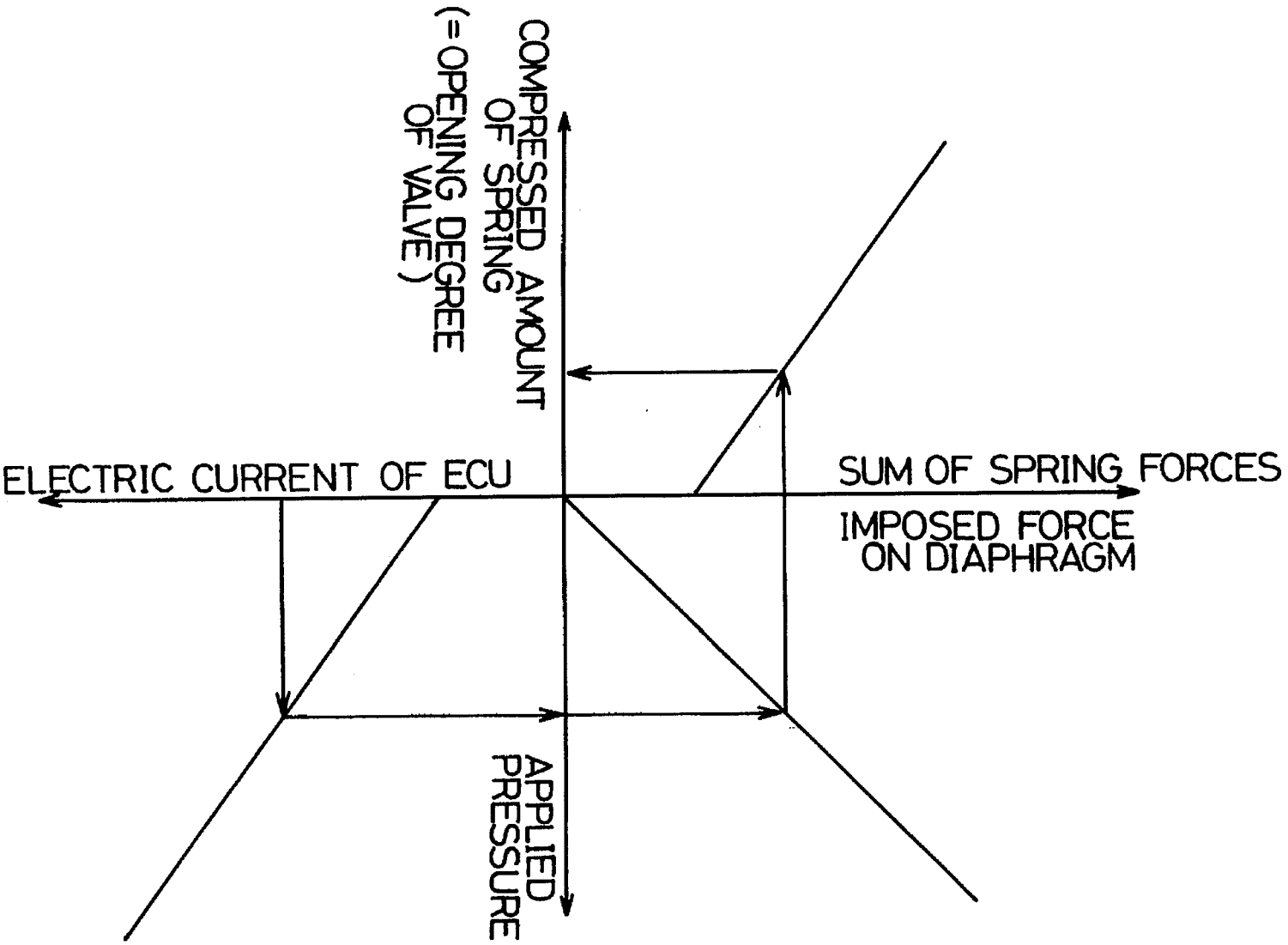
FIG. 5 is a graph to explain the control of the first embodiment.

In this case, as shown in FIG. 5, a command (electric current) from ECU 20 determines air pressure to be supplied to EGR valve 30, and the air pressure determines a force imposed on diaphragm 44. An opening degree of EGR valve 30 is determined according to the balance between the force imposed on diaphragm 44 and compressed coil spring 35 and the like. Thus, the opening degree of EGR valve 30 is accurately controlled in response to electric supply of ECU 20.

A second embodiment is described in detail with reference to FIGS. 10–13.

In this second embodiment, second electromagnetic valve 114 of the first embodiment is not employed but only first electromagnetic valve 113 is employed. A constant pressure shutoff mechanism is incorporated into the proportional control valve to automatically close the input port at the pressure supply side when pressure at the air compressor side of the inlet port in the proportional control valve is less than a predetermined value.

The second embodiment is equipped with a constant pressure shutoff mechanism in a first supplying passage 99 in addition to first electromagnetic valve 113 in first supplying passage 99. A second electromagnetic valve 114 for opening or closing control passage 55 is disposed in control passage 55 in the same manner as the first embodiment.

Figure 10:
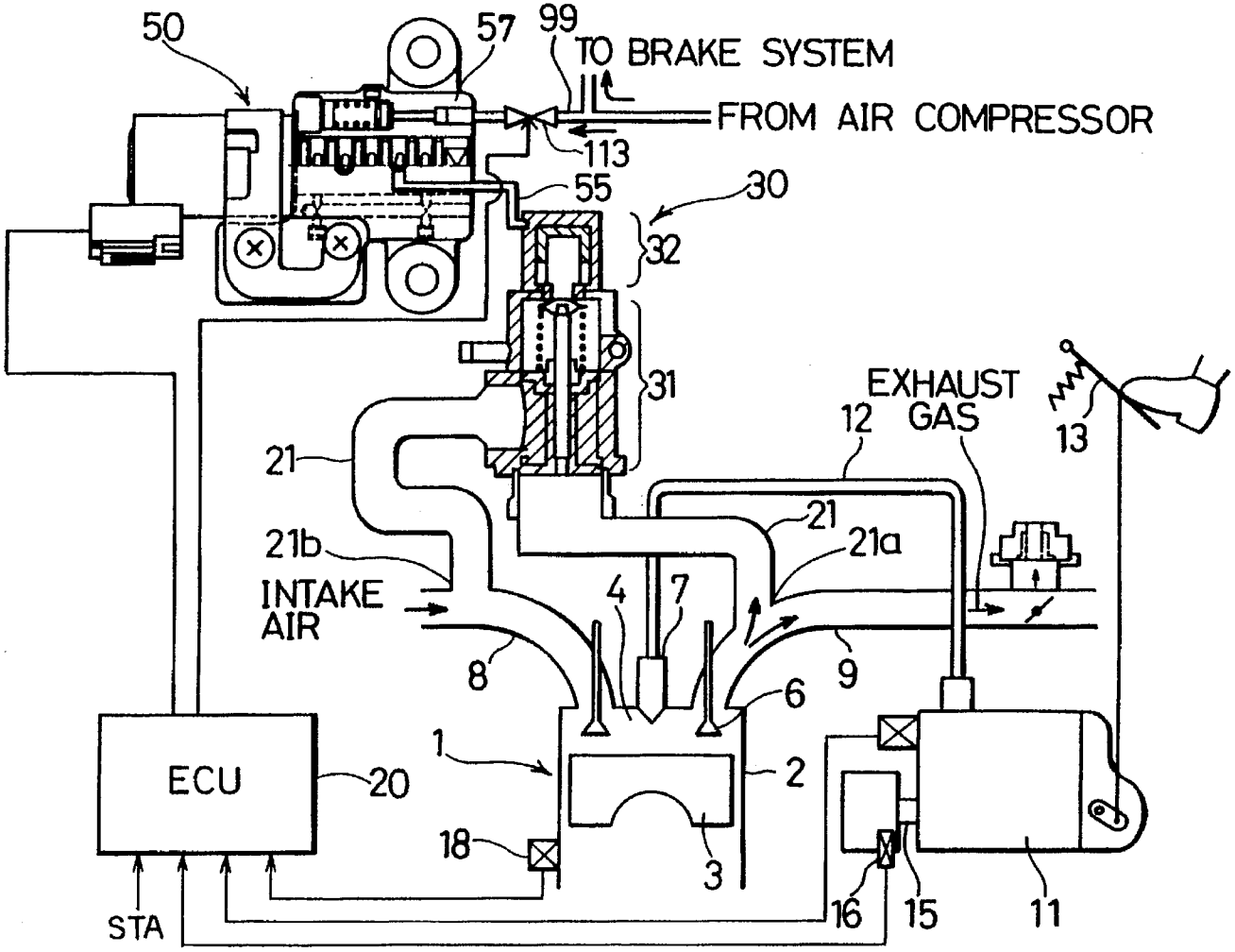
FIG. 10 is a construction view of a system according to a second embodiment according to the present invention.
Figure 11:
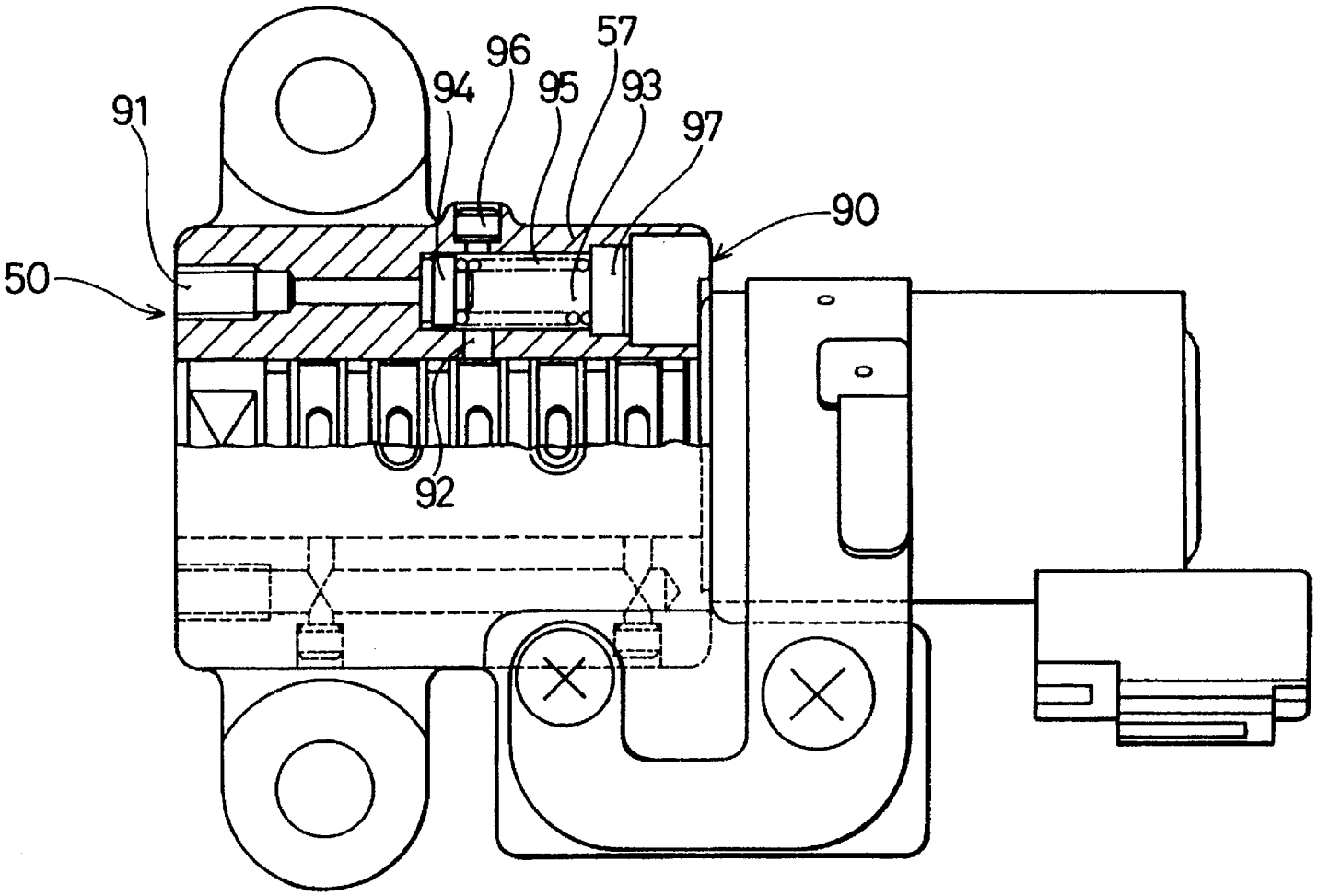
FIG. 11 is a partial cross sectional view of the proportional electromagnetic control valve of the second embodiment.

FIGS. 10 and 11 show detail structure of the second embodiment. FIG. 10 shows a construction of the system employing a proportional control valve having the constant pressure shutoff mechanism therein.

Figure 12:
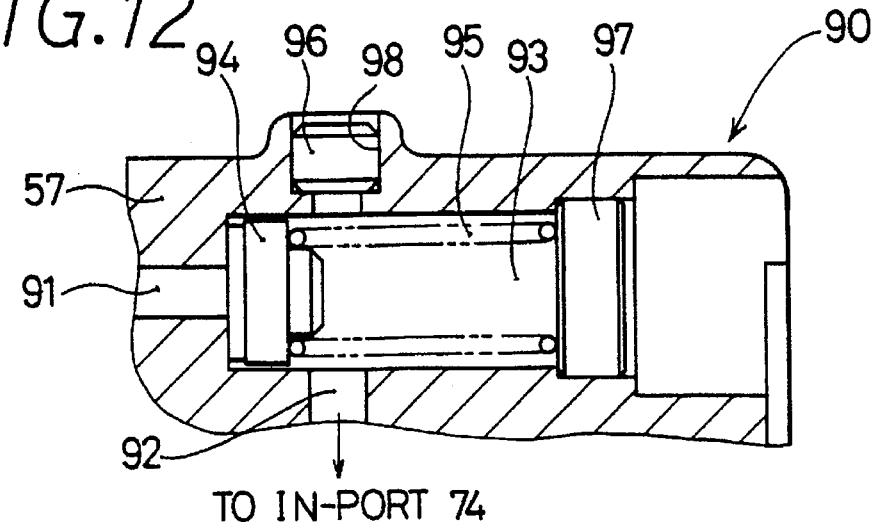
FIG. 12 is a cross sectional view of a constant pressure shutoff mechanism.

As shown in FIGS. 11 and 12, spool valve 50 includes constant pressure shutoff mechanism 90 at the side of IN port 74. Constant pressure shutoff mechanism 90 includes a round cylindrical hole 93 formed on valve body 57, pressure transmitting passage 99 communicating round cylindrical hole 93 with air compressor 81, inlet passage 91 communicating with pressure transmitting passage 99, output passage 92 communicating with IN port 74 of spool valve 50. A valve member 94 is disposed in round cylindrical hole 93 to close inlet passage 91. Compressed coil spring 95 is disposed to urge valve member 94 in a closed direction. A blank cap 97 is fixedly press-fitted into the opening end of round cylindrical hole 93. One end of compressed coil spring 95 contacts with valve member 94 and the other end contacts with blank cap 97. An outlet passage 98 is drilled from the outside of valve body 57. A blank cap 96 is fixedly press-fitted into the opening of the outlet passage 98.

In the second embodiment, when the differential pressure between inlet passage 91 and outlet passage 92 reaches a certain predetermined value or more, valve member 94 moves while resisting the force of compressed coil spring 95 to communicate inlet passage 91 with outlet passage 92. When the differential pressure between inlet passage 91 and outlet passage 92 is less than the predetermined value, the communication between inlet passage 91 and outlet passage 92 is interrupted. Accordingly, when pressure at the side of the compressor is less than the predetermined value, valve member 94 is seated to close so that the pressure at the side of IN port 74 of spool valve 50 is maintained at the predetermined pressure value or more.

Figure 13:
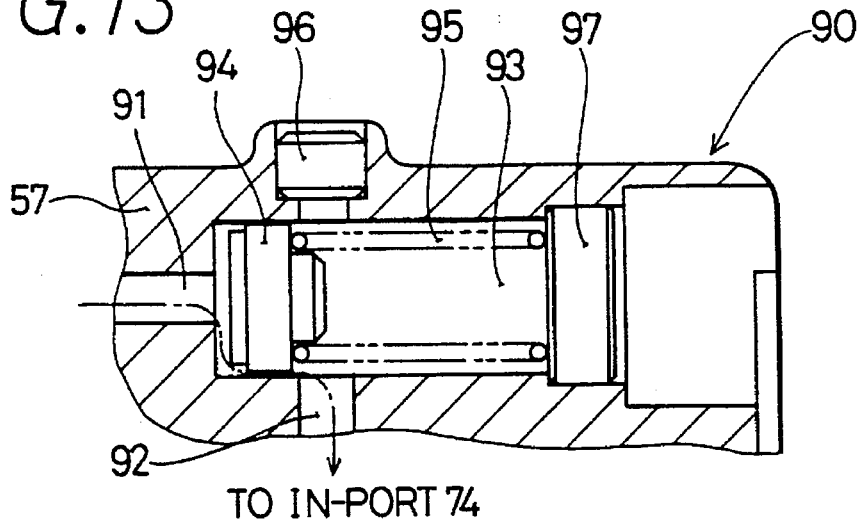
FIG. 13 is a cross sectional view to explain the operation of the constant pressure shutoff mechanism shown in FIG. 12.

An operation of the second embodiment is described with reference to FIG. 13. When the differential pressure between inlet passage 91 and outlet passage 92 is a predetermined value or more, valve member 94 moves from the position in FIG. 12 to the position shown in FIG. 13 while resisting the force of compressed coil spring 95 to communicate inlet passage 91, round cylindrical hole 93 and outlet passage 92 with each other, so that positive pressure at the side of compressor can be introduced to IN port 74 side of spool valve 50. Contrarily, when the differential pressure in inlet passage 91 and outlet passage 92 is less than the predetermined value, compressed coil spring 95 urges valve member 94 to interrupt the communication between inlet passage 91 and outlet passage 92.

A switching operation of EGR valve 30 as well as an operation of first electromagnetic valve 113 is described.

When EGR valve 30 is closed, first electromagnetic valve 113 is also closed. When an EGR amount is increased from the closed state of EGR valve 30, first electromagnetic valve 113 is switched to be opened. Then, pressure from air compressor 81 as a positive pressure supply source is supplied to actuating portion 32 of EGR valve 30 as operational pressure from control passage 55 via spool valve 50. When the operational pressure of actuating portion 32 reaches the target value and is maintained, first electromagnetic valve 113 remains open.

When an EGR amount is decreased from the state of the aforementioned desired opening degree of EGR valve 30, the opening degree of EGR valve 30 is reduced. In this case, first electromagnetic valve 113 remains closed to control spool valve 50. The operational pressure of actuating portion 32 is released to the atmosphere from spool valve 50 through control passage 55 to lower the operational pressure of actuating portion 32 and to reduce the opening degree of EGR valve 30. Furthermore, in case an EGR amount is decreased from the state of the aforementioned desired opening degree of EGR valve 30, first electromagnetic valve 113 can be opened to adjust both the atmospheric pressure and the positive pressure supplied by air compressor 81 within spool valve 50, so that the opening degree of EGR valve 30 can be reduced.

According to the second embodiment, when the internal combustion engine is stopped and sequentially pressure within an accumulator tank of inlet passage 91 at the side of air compressor 81 decreases, constant pressure shutoff mechanism 90 of the proportional control valve is actuated to close valve member 94 in order to maintain the pressure within the accumulator tank of air compressor 81 at a predetermined value or more. Therefore, it is prevented to cause any adverse effect on other systems utilizing the pressure of the accumulator chamber of air compressor 81. For example, malfunction of brake system can be prevented.

Since constant pressure shutoff mechanism 90 is integrally incorporated in spool valve 50 and a portion of valve body 57 is used for constant pressure shutoff mechanism 90, a small-sized EGR apparatus can be manufactured at low cost with minimized number of parts required while maintaining the pressure at the input response side of spool valve 50 at a predetermined value or more. Consequently assembly, transport, maintenance, and inspection can be easily performed.

Moreover, in the second embodiment, operational pressure of air compressor 81 is consumed only when actuating portion 32 of EGR valve 30 increases and maintains the operational pressure, so that load of air compressor 81 can be reduced, and therefore, it is possible to manufacture a small-sized air compressor 81 and improve fuel efficiency of the internal combustion engine for actuating air compressor 81. Since positive pressure of air compressor 81 is used only in case of necessity, positive pressure accumulated in air compressor 81 can be prevented from leaking from spool valve 50.

In this embodiment, ECU 20 may control first electromagnetic valve 113 to be opened when exhaust gas recirculates in the air at the inlet side in EGR valve 30 and first electromagnetic valve 113 to be closed when exhaust gas does not recirculate in the air at the inlet side. In this case, since first electromagnetic valve 113 is closed when EGR valve 30 is not being actuated, pressure of positive pressure source of brake system 82 is interrupted so that positive pressure accumulated in air compressor 81 can be prevented from leaking from spool valve 50.

Constant pressure shutoff mechanism 90 employed in the second embodiment can be omitted.

Second electromagnetic valve 114 employed in the first embodiment can be applied to the second embodiment.

A third embodiment of the present invention is described with reference to FIG. 14.

Figure 14:
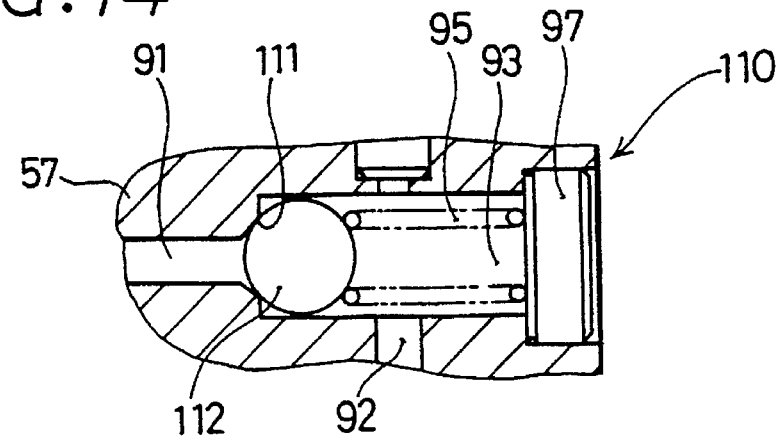
FIG. 14 is a cross sectional view of the constant pressure shutoff mechanism of a third embodiment according to the present invention.

The third embodiment shown in FIG. 14 employs a ball valve as a constant pressure shutoff mechanism. A ball valve as a constant pressure shutoff mechanism 110 is incorporated into valve body 57 of spool valve 50 in the same manner as the second embodiment. A ring-shaped valve seat 111 is formed in inlet passage 91 of valve body 57. A ball 112 selectively abuts or is separated from valve seat 111. Since the other components are same as in FIG. 12, the explanation is omitted.

According to the third embodiment, constant pressure shutoff mechanism 110 is employed in addition to first electromagnetic valve 113, and therefore, it is possible not only to simplify the mechanical structure of EGR apparatus simple but also to maintain the original pressure at the input port side of the proportional control valve at a predetermined value or more.

Figure 15:
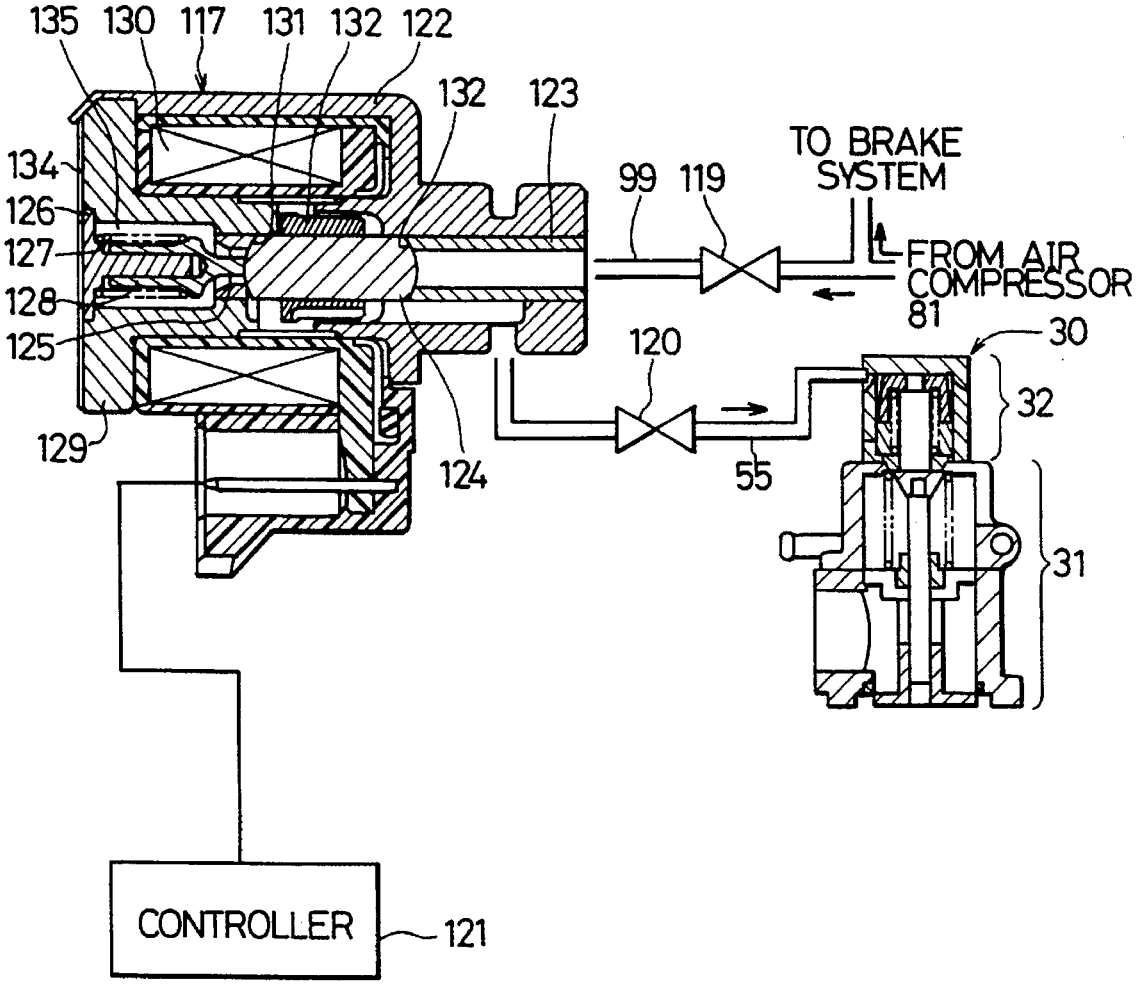
FIG. 15 is a system construction view showing main portions of a fourth embodiment according the present invention.

A fourth embodiment is described with reference to FIG. 15.

In the fourth embodiment, a duty solenoid valve 117 is employed instead of spool valve 50 employed as the proportional electromagnetic control valve in the first embodiment. A first and a second air switching valves 119 and 120 are employed instead of first and second electromagnetic valves 113 and 114 in the first embodiment. Duty solenoid valve 117 is controlled according to the amount of the electric current based on a command signal from an exclusive controller 121 so that the opening/closing amount of duty solenoid valve 117 is controlled.

In duty solenoid valve 117, a pipe 123 is fixedly inserted into a valve housing 122 containing a coil 130 therein. A valve body 129 is fixed to valve housing 122 by crimping. A spring seat 126 contacts with one end of a compressed coil spring 127 inside a plate 134 which is fixed to the opening of valve body 129 by crimping. The other end of compressed coil spring 127 urges a pressing member 128 in the right direction in FIG. 15. The edge of pressing member 128 imposes pressure on valve body 124 in the right direction. A movable cylinder 133 is disposed around valve body 124. The right edge of valve body 124 is adapted to contact with a valve seat 132 of pipe 123 and the other edge of valve body 124 is adapted to contact with a first valve seat 131 of a valve seat member 125 press-fitted into valve body 129.

Controller 121 exclusively used for duty solenoid valve 117 controls duty ratio of duty solenoid valve. In accordance with a pulse signal transmitted by controller 121, magnetic flux density formed by excitement of coil 130 is determined. On the basis of the situation of the magnetic flux density, a movable cylindrical body 133 moves in the horizontal direction in FIG. 15 depending on the electromagnetic attraction force while resisting the force of compressed coil spring 127. Valve body 124 fixing movable cylindrical body 133 contacts with a second valve seat 132 when returning to the rightward original position in order to close the pressure transmitting passage at positive pressure source side. At this time, the atmospheric pressure is introduced to control passage 55 through first valve seat 131 from a spring chamber 135. Contrarily, when valve body 124 reaches the most leftward position in FIG. 15, the left edge of valve body 124 contacts with first valve seat 131 to introduce the positive pressure in the first supplying passage to control passage 55 through second valve seat 132. Valve body 124 reciprocates according to duty ratio. The reciprocating movement mixes the positive pressure and the atmospheric pressure so as to obtain optimum controlling pressure, thus adjusting the opening degree of EGR valve 30.

In the fourth embodiment, pressure mixed with the positive and atmospheric pressures is introduced to control passage 55. Since the desired controlling pressure is produced promptly and properly, it is possible to obtain precise control and rapid response of EGR valve 30.

The present invention has been described in connection which what are presently considered to be the most practical preferred embodiments. However, the invention is not meant to be limited to the disclosed embodiments, but rather is intended to include all modifications and alternative arrangements included within the spirit and scope of the appended claims.

What is claimed is:

1. An exhaust gas recirculation control apparatus for recirculating a part of exhaust gas into an internal combustion engine comprising:

positive pressure supplying source for generating positive pressure being higher than atmospheric pressure;

a control valve for adjusting said positive pressure of said positive pressure supplying source to a predetermined pressure by mixing atmospheric pressure therewith;

an exhaust gas recirculation valve for controlling an amount of exhaust gas to be recirculated into said internal combustion engine according to said predetermined pressure upon receipt thereof;

a first switching valve for controlling communication between said positive pressure supplying source and said control valve; and control means for controlling opening or closing of said first switching valve;

wherein said control means controls said first switching valve to be opened only when said predetermined pressure supplied to said exhaust gas recirculation valve is increased and maintained.

2. An exhaust gas recirculation control apparatus according to claim 1, wherein said positive pressure supplying source is a brake system for braking the rotational speed of said internal combustion engine by compressed air.

3. An exhaust gas recirculation control apparatus according to claim 1, further comprising:

a second switching valve for controlling communication between said control valve and said exhaust gas recirculation valve, wherein, said control means controls said second switching valve to be opened when said predetermined pressure supplied to said exhaust gas recirculation valve is increased, and said control means controls said second switching valve to be closed when said predetermined pressure supplied to said exhaust gas recirculation valve is maintained.

4. An exhaust gas recirculation control apparatus according to claim 1, further comprising:

a constant pressure valve for closing communication between said positive pressure supplying source and said control valve when a differential pressure between said positive pressure of said positive pressure supplying source and a positive pressure of said control valve is less than a predetermined value.

5. An exhaust gas recirculation control apparatus according to claim 1, wherein said control valve includes:

a housing having an inlet port, an outlet port and an atmospheric port, said inlet port receiving said positive pressure from said positive pressure supplying source, said outlet port discharging said predetermined pressure to said exhaust gas recirculation valve, said atmospheric port communicating with atmospheric pressure;

an electromagnetic coil for generating attracting force when electric current is supplied thereto;

a movable shaft moved by said attracting force of said attracting coil;

a spool slidably disposed within said housing and shifted by movement of said movable shaft, said spool having a cylindrical land portion for controlling communication between said outlet port and said inlet port in proportion to movement of said spool.

6. An exhaust gas recirculation control apparatus according to claim 5, wherein said exhaust gas recirculation valve includes:

a case having a pressure chamber supplied with said predetermined pressure from said control valve and an atmospheric pressure chamber communicating with the atmospheric pressure;

a cylindrical movable member disposed in said atmospheric pressure chamber and moved according to said predetermined pressure;

a diaphragm disposed in said case to define said pressure chamber and said atmospheric pressure chamber within said case, said diaphragm including a first contacting portion in contact with an inner wall of said pressure chamber of said case, a second contacting portion in contact with a cylindrical outer periphery of said movable member, and a connecting portion for connecting said first contacting portion with said second contacting portion; and exhaust gas amount controlling means for controlling an amount of exhaust gas to be recirculated into said internal combustion engine according to movement of said movable member;

said connecting portion moves to said atmospheric pressure chamber when said predetermined pressure is introduced into said pressure chamber, and said connecting portion and said second contacting portion smoothly roll along said inner wall of said pressure chamber from said cylindrical outer periphery of said movable member.

7. An exhaust gas recirculation control apparatus according to claim 1, wherein said control valve is a duty solenoid valve including:

a housing an inlet port, an outlet port, and an atmospheric port, said inlet port receiving said positive pressure from said positive pressure supplying source, said outlet port discharging said predetermined pressure to said exhaust gas recirculation valve, said atmospheric port communicating with atmospheric pressure;

an electromagnetic coil for generating attracting force when electric current is supplied thereto;

a movable valve, slidably disposed within said housing and moved by said attracting force, for selectively communicating said outlet port with said inlet port or said atmospheric port; and duty ratio controller for controlling duty ratio of said electric current supplied to said electromagnetic coil to adjust said positive pressure to said predetermined pressure.

8. An exhaust gas recirculation control apparatus for recirculating a part of exhaust gas into an internal combustion engine comprising:

positive pressure supplying source for generating positive pressure being higher than atmospheric pressure;

a control valve for adjusting said positive pressure of said positive pressure supplying source to a predetermined pressure by mixing atmospheric pressure therewith;

an exhaust gas recirculation valve for controlling an amount of exhaust gas to be recirculated into said internal combustion engine according to said predetermined pressure upon receipt thereof;

a first switching valve for controlling communication between said positive pressure supplying source and said control valve; and control means for controlling opening or closing of said first switching valve;

wherein said control means controls said first switching valve to be opened only when said exhaust gas is recirculated into said internal combustion engine.

9. An exhaust gas recirculation control apparatus according to claim 8, wherein said positive pressure supplying source is a brake system for braking the rotational speed of said internal combustion engine by compressed air.

10. An exhaust gas recirculation control apparatus according to claim 8, further comprising:

a second switching valve for controlling communication between said control valve and said exhaust gas recirculation valve, wherein, said control means controls said second switching valve to be opened when said predetermined pressure supplied to said exhaust gas recirculation valve is increased, and said control means controls said second switching valve to be closed when said predetermined pressure supplied to said exhaust gas recirculation valve is maintained.

11. An exhaust gas recirculation control apparatus according to claim 8, further comprising:

a constant pressure valve for closing communication between said positive pressure supplying source and said control valve when a differential pressure between said positive pressure of said positive pressure supplying source and a positive pressure of said control valve is less than a predetermined value.

12. An exhaust gas recirculation control apparatus according to claim 8, wherein said control valve includes:

a housing having an inlet port, an outlet port and an atmospheric port, said inlet port receiving said positive pressure from said positive pressure supplying source, said outlet port discharging said predetermined pressure to said exhaust gas recirculation valve, said atmospheric port communicating with atmospheric pressure;

an electromagnetic coil for generating attracting force when electric current is supplied thereto;

a movable shaft moved by said attracting force of said attracting coil;

a spool slidably disposed within said housing and shifted by movement of said movable shaft, said spool having a cylindrical land portion for controlling communication between said outlet port and said inlet port in proportion to movement of said spool.

13. An exhaust gas recirculation control apparatus according to claim 12, wherein said exhaust gas recirculation valve includes:

a case having a pressure chamber supplied with said predetermined pressure from said control valve and an atmospheric pressure chamber communicating with the atmospheric pressure;

a cylindrical movable member disposed in said atmospheric pressure chamber and moved according to said predetermined pressure;

a diaphragm disposed in said case to define said pressure chamber and said atmospheric pressure chamber within said case, said diaphragm including a first contacting portion in contact with an inner wall of said pressure chamber of said case, a second contacting portion in contact with a cylindrical outer periphery of said movable member, and a connecting portion for connecting said first contacting portion with said second contacting portion; and exhaust gas amount controlling means for controlling an amount of exhaust gas to be recirculated into said internal combustion engine according to movement of said movable member;

said connecting portion moves to said atmospheric pressure chamber when said predetermined pressure is introduced into said pressure chamber, and said connecting portion and said second contacting portion smoothly roll along said inner wall of said pressure chamber from said cylindrical outer periphery of said movable member.

14. An exhaust gas recirculation control apparatus according to claim 8, wherein said control valve is a duty solenoid valve including:

a housing an inlet port, an outlet port, and an atmospheric port, said inlet port receiving said positive pressure from said positive pressure supplying source, said outlet port discharging said predetermined pressure to said exhaust gas recirculation valve, said atmospheric port communicating with atmospheric pressure;

an electromagnetic coil for generating attracting force when electric current is supplied thereto;

a movable valve, slidably disposed within said housing and moved by said attracting force, for selectively communicating said outlet port with said inlet port or said atmospheric port; and duty ratio controller for controlling duty ratio of said electric current supplied to said electromagnetic coil to adjust said positive pressure to said predetermined pressure.

15. An exhaust gas recirculation control apparatus for recirculating a part of exhaust gas into an internal combustion engine comprising:

positive pressure supplying source including an air compressor for generating positive pressure being higher than atmospheric pressure to actuate a brake system for braking the rotational speed of said internal combustion engine;

a control valve for adjusting said positive pressure of said positive pressure supplying source to a predetermined pressure by mixing atmospheric pressure therewith;

an exhaust gas recirculation valve for controlling an amount of exhaust gas to be recirculated into said internal combustion engine according to said predetermined pressure upon receipt thereof;

a first switching valve for controlling communication between said positive pressure supplying source and said control valve; and a second switching valve for controlling communication between said control valve and said exhaust gas recirculation valve;

control means for controlling opening or closing of said first and said second switching valves, said control means opening said first switching valve only when said exhaust gas is recirculated into said internal combustion engine;

wherein said control means controls said first and said second switching valves such that said first and second switching valves are opened when said predetermined pressure supplied to said exhaust recirculation valve is increased, and said first and second switching valves are closed when said predetermined pressure supplied to said exhaust recirculation valve is maintained.

* * * * *